US006551065B2

(12) United States Patent
Lee

(10) Patent No.: US 6,551,065 B2
(45) Date of Patent: Apr. 22, 2003

(54) FAN PROTECTION DEVICE

(75) Inventor: Andy Lee, Taipei (TW)

(73) Assignee: Mitac International Corporation, Hsinchu (TW)

( * ) Notice: Subject to any disclaimer, the term of this patent is extended or adjusted under 35 U.S.C. 154(b) by 0 days.

(21) Appl. No.: 09/875,894

(22) Filed: Jun. 8, 2001

(65) Prior Publication Data

US 2002/0187049 A1 Dec. 12, 2002

(51) Int. Cl.[7] ..... F04B 49/10

(52) U.S. Cl. ..... 417/32; 417/44.1; 318/471; 318/478; 361/23; 361/78

(58) Field of Search ..... 417/32, 22, 44.1; 361/78, 79, 103, 23; 318/471, 472, 474, 798, 461, 811

(56) References Cited

U.S. PATENT DOCUMENTS 5,168,415 A * 12/1992 Osuga ..... 361/28
5,534,854 A * 7/1996 Bradbury et al. ..... 340/648
5,539,601 A * 7/1996 Farag ..... 361/23
5,831,405 A * 11/1998 Massie ..... 318/471
6,023,402 A * 2/2000 Kaminski ..... 361/103
6,040,668 A * 3/2000 Huynh et al. ..... 318/471
6,122,153 A * 9/2000 Becker ..... 361/25
6,135,718 A * 10/2000 Yang ..... 417/22

* cited by examiner

*Primary Examiner*—Cheryl J. Tyler
*Assistant Examiner*—Han L. Liu
(74) *Attorney, Agent, or Firm*—Intellectual Property Solutions, Incorporated

(57) ABSTRACT

A device to protect fans from overheating and overloading with driving current. The fan protection device of the present invention monitors the temperature and current change of the operating fan. When the temperature or the current float surpasses a predetermined value, the protection device cuts off the fan's power supply and avoids damage to the unit.

5 Claims, 2 Drawing Sheets

FAN PROTECTION DEVICE

BACKGROUND OF THE INVENTION

1. Field of the Invention

The present invention relates in general to a fan protection device, more particularly to a protection device to protect a fan from overpowering and overheating.

2. Description of the Related Art

Conventional fan protection devices are activated to allow the fans to be shut down when blockage or stalling of the fan is caused by obstacles or less obvious reasons. Fatigue in fan-shafts is unavoidable due to constant use, added to the increase in friction, resulting in heat generation and larger driving current. Thus fans may constantly overheat or overload with large current. Either case will increase the likelihood of fans igniting. This not only damages the fans, but also imposes a greater danger on the systems cooled by the fans. Moreover, when fans are obstructed by obstacles, they may not come to a complete halt, and the continued rotation requires increased current to sustain. When there is no device in conventional fan protection devices to detect such a situation, this kind of damage occurs easily, shortening the life span of the fan and posing great danger to its environment.

SUMMARY OF THE INVENTION

An object of the present invention is to provide a fan protection device as shown in FIG. 1, comprising: a temperature detector 10, a current detector 12 and an alarm unit 14. The temperature detector 10 is used to detect overheating of the fan. The temperature detector 10 comprises a temperature-voltage transformer 10*a* and an overheating-judgment device 10*b*. The temperature-voltage transformer 10*a* is located at the thermo-generating source of the fan, to transform the thermo-energy thereof into a corresponding voltage signal Vt; and the overheating-judgment device 10*b* is used to determine whether the fan temperature exceeds a predetermined temperature according to an output voltage signal Vt from the temperature-voltage transformer 10*a* and then deciding whether the fan is overheated.

The current detector 12 is used for detecting overload of driving current of the fan. The current detector 12 comprises a current-voltage transformer 12*a* and an overload-judgment device 12*b*. The current-voltage transformer 12*a* is located on the path of the current flow of the fan, for transforming the current of the fan into a corresponding voltage signal Vi; and the overload-judgment device 12*b* is used to determine whether the current of the fan surpasses a predetermined current according to the current-voltage transformer 12*a* and deciding whether the fan is overloaded.

The alarm unit 14 may function as a lockup device. When the fan is operating normally, the lockup device sends a signal V0 of a first state to keep the switch SW conductive, and allows the fan to maintain normal operations. If one of the overheating and overload of the fan is detected, the lockup device outputs a signal of a second state to cut off the power supply to the fan to stop the fan from operating, until the lockup device is reset.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

Figure 2:
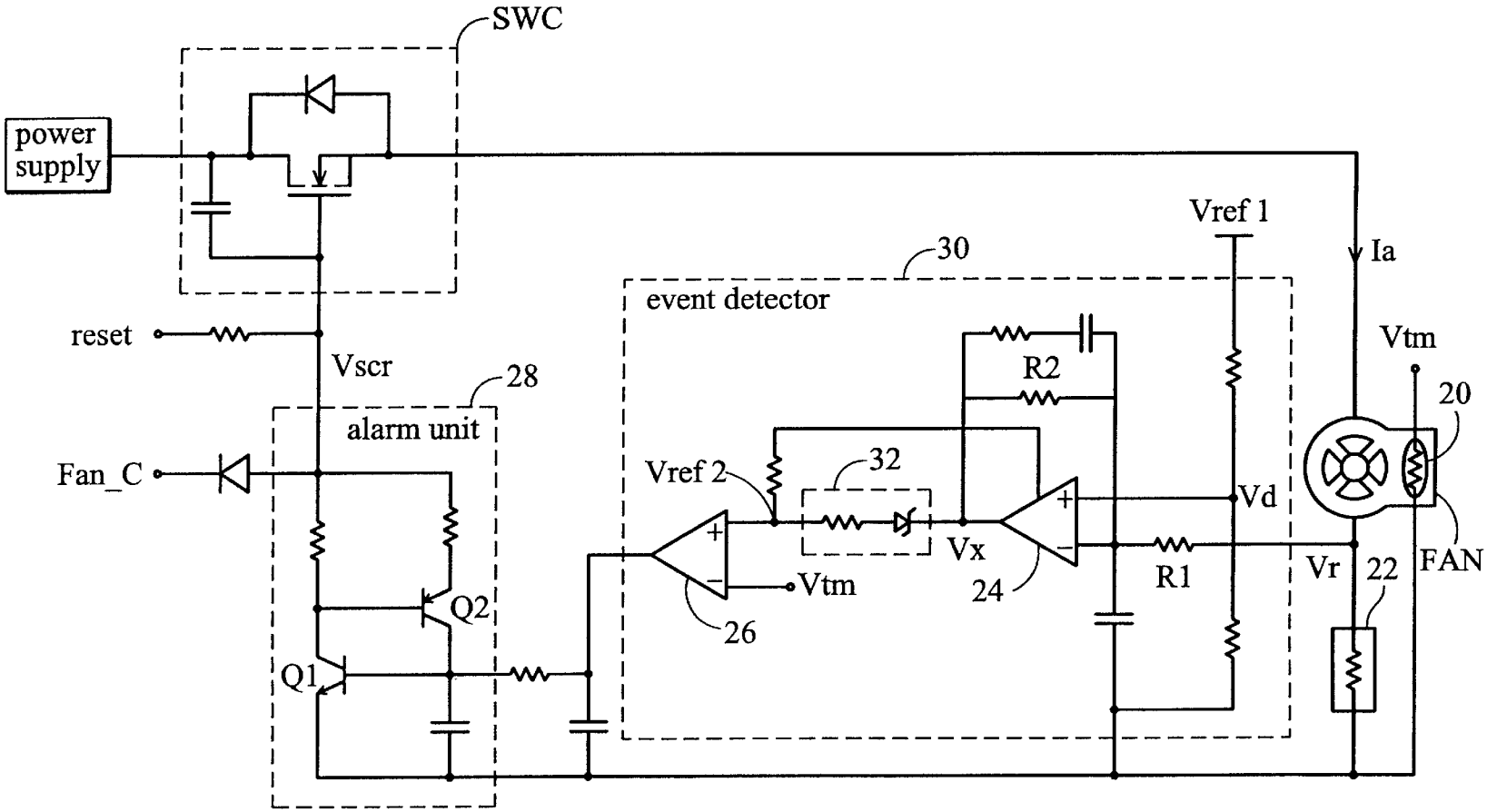
FIG. 2 is a perspective diagram of the circuit of the present invention.

FIG. 2 is the schematic circuit diagram of the embodiment of the present invention. The fan protection device of the present invention comprises the following unit:

- a thermistor 20, located at the thermo-generating source of the fan, for transforming thermo-energy generated by the thermistor into voltage-difference Vtm across the thermister 20.
- a current-voltage transformer 22, located on the path of the current flow of the fan, for transforming the current of the fan Ia into voltage difference Vr across the current-voltage transformer;
- a event detector 30, comprising a first comparator 24 which compares the voltage difference Vr across the transformer 22 with a voltage Vd of a first predetermined voltage Vref1, and if the voltage difference Vr across the transformer 22 is greater than voltage Vd of the first predetermined voltage Vref1, the current of the fan being greater than a predetermined current is detected; and a second comparator, for comparing the voltage difference Vtm across the thermistor 20 with a predetermined second voltage Vref2, if the voltage difference Vtm across the thermistor 20 is greater than the second predetermined voltage Vref2, the temperature of the fan being greater than a predetermined temperature is detected.
- an alarm unit 28, in the current embodiment, the alarm unit comprises an SCR (Silicon-controlled circuit) having NPN transistors Q1 and Q2. When the event detector 30 detects an unusual event, the alarm unit 28 cuts off the fan's power supply to stop the fan from operating and outputs a signal Fan_C to indicate the occurrence of an unusual situation.

The detail operation mechanism of the present invention is further described as followed:

The thermistor 20 located at the thermo-generating source is characterized such that the voltage difference across it is inversely proportional to the temperature change, so the voltage difference Vtm becomes smaller as the temperature of the fan becomes higher. The voltage difference Vtm becomes smaller than the second predetermined voltage Vref2 when the temperature of the fan exceeds the limit. The second comparator 26 then outputs a high-voltage signal to trigger the SCR circuit. And the SCR circuit outputs a voltage signal Vscr with a low-voltage state to close the NMOS transistor in switch SWC to cut off the fan power supply. The switch SWC can only be open again by resetting (removing and re-applying) the voltage signal at the SCR reset end, eg: 12V, to let the SCR output signal bounce back to the high-voltage state again.

The voltage difference Vtm is always higher than the second predetermined voltage Vref2 when the temperature does not surpass the limit. And the second comparator 26 thereby outputs a low-voltage signal which does not trigger the SCR. Therefore, the NMOS transistor in the switch SWC remains conductive to allow the power to continuingly supply to the fan.

In the current embodiment, the first comparator 24 is incorporated with transistors R1 and R2 to become an amplifier with an output signal $Vx=(R2/R1)(Vr-Vd)+Vd$.

The signal Vx passes though a separating device 32 comprised of a resistor and a zener diode, and is then coupled to the input end of the second parameter 26. If the resistance of the transformer 22 is 0.05, and the first predetermined current limit is 0.1A, and the resistance divided voltage Vd of the first determined voltage Vref1 is 0.005.

The first comparator constantly compares the voltage difference Vr across the transformer 22 to the resistance divided voltage Vd. Under normal conditions, Vr is always smaller than Vd so that Vx output by the first comparator 24 is negative which does not have any effect on the second comparator 26. And the second comparator keeps comparing the voltage difference Vtm across the thermistor 20 and the second predetermined voltage Vref2 to determined whether the fan is overheated.

However, when the current Ia surpasses the predetermined current 0.1A, the first comparator 24 amplifies the voltage difference between Vr and Vd to a ratio of R2/R1, and the amplified signal is output as a positive voltage Vx=(R2/R1)(Vr−0.005)+0.005 greater than the second predetermined voltage Vref2 so that the second comparator 26 outputs a high-voltage signal to trigger the SCR circuit and the SCR circuit outputs a voltage signal Vscr in a low-voltage state to close the NMOS transistor in the switch SWC which cuts off the power supply of the fan. The switch SWC can only be triggered again by resetting (removing and re-applying) the voltage signal at the SCR reset end, eg: 12V, to let the SCR outputs signal bounce back to the high-voltage state once more.

Figure 1:
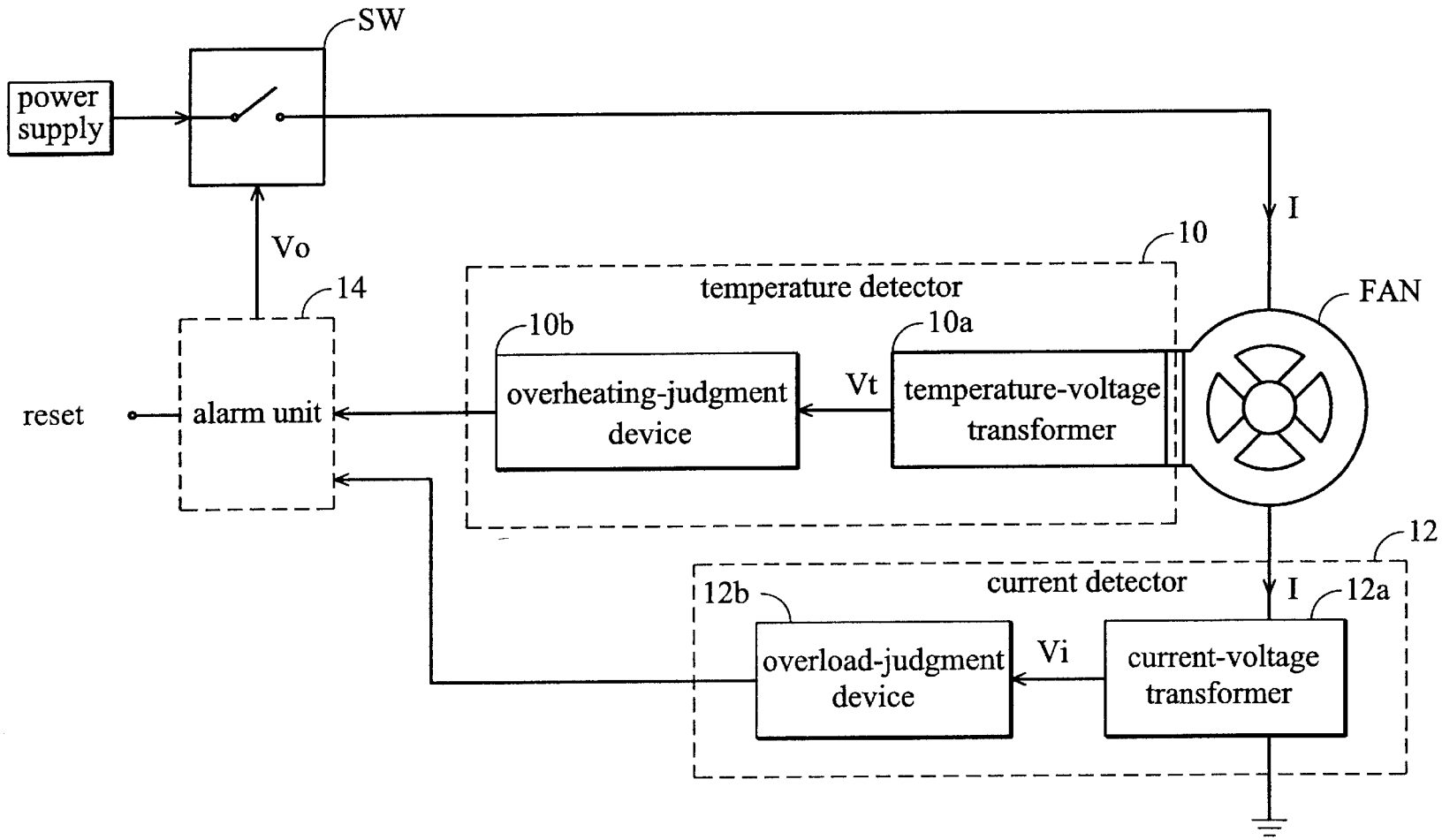
FIG. 1 is a diagram of the circuit structure of the present invention.

The output signal Vx of the first comparator 24 triggers the SCR in the alarm unit 28 to directly protect the fan from an overload of the driving current. The current detecting unit 12 (as shown in FIG. 1) comprising the first comparator 24 and the current/voltage transformer 22 is used to detect fan overload events. The temperature-detecting unit 10 (as shown in FIG. 1) comprising the second comparator 26 and the thermistor 20 is used to detect the fan overheating events.

The fan protection device, as described above, monitors the temperature and current of the fan constantly. When the fan is overheated or its current flow surpasses a limit, the protection device of the present invention cut off the power supply to the fan to prevent further destruction. So, the fan protection device of the present invention detects such accidental events of temperature rising or power supply overshooting abnormally caused from fatigue of the fan, obstacle blockage, short circuit or other unknown reasons and cut off the power supply so that the problems can be solved. The fan protection device thus, not only prolongs the life of fans, but also excludes the threat causing the fans on fire.

What is claimed is:

1. A fan protection device, to protect a fan, comprising:

a temperature detector, for detecting overheating of the fan, having a temperature-voltage transformer, located at the thermo-generating source of the fan to transform the thermo-energy thereof into a corresponding voltage signal, and an overheating-judgment device to determine whether the temperature of the fan exceeds a predetermined temperature according to the voltage signal output from the temperature-voltage transformer and, further, detect whether the fan is overheated;

a current detector coupled to the temperature detector to detect driving-current overload of the fan, wherein the current detector has a current-voltage transformer located on the path of the current flow of the fan to transform the current of the fan into a corresponding voltage signal, and an overloading-judgment device to determine whether the current of the fan surpasses a predetermined current value according to the voltage signal output from the current-voltage transformer and, further, detecting whether the fan is overloaded; and an alarm unit, for stopping the fan when an event is detected.

2. The protection device as claimed in claim 1, wherein the alarm unit is a lockup device; when the fan is in normal condition, the lockup device outputs a signal of a first state to allow the fan to continue normal operations; if an overheating and/or overloading event is detected, the lockup device outputs a signal of a second state to cut off the power supply to the fan and stop the fan from operating until the lockup device is reset.

3. A fan protection device, to protect a fan, comprising:

a thermistor, located at the thermo-generating source of the fan, for transforming thermo-energy generated hereof into voltage difference across the thermistor;

a current-voltage transformer, located on the path of the current flow of the fan and coupled to the thermistor, the current-voltage transformer transforms the current of the fan into voltage difference across the current-voltage transformer;

an event detector coupled to the thermistor and the current-voltage transformer, the event detector detects unusual events such as overheating and current overload affecting the fan, wherein the event detector comprises:

at least one first comparator coupled to current-voltage transformer to compare the voltage difference across the transformer with a first predetermined voltage, wherein, if the voltage difference across the transformer is greater than the first predetermined voltage, the current of the fan exceeding a predetermined current is detected; and at least one second comparator coupled to the thermistor to compare the voltage difference across the thermistor with a predetermined second voltage, wherein, if the voltage difference across the thermistor is greater than the second predetermined voltage, the temperature of the fan exceeding a predetermined temperature is detected; and an alarm unit coupled to the event detector to stop the fan when the event detector detects he unusual events hereof.

4. The protection device as claimed in claim 3, wherein the alarm unit is a lockup device; when the fan is in normal condition, the lockup device outputs a signal of a first state to allow the fan operating normally; if an overheating and/or overloading event affecting the fan is detected, the lockup device outputs a signal with a second state to cut off the power supply to the fan so that the operation of the fan is stopped, until the lockup device is reset.

5. The protection device as claimed in claim 4, wherein the alarm unit is comprised of a SCR circuit.

* * * * *